US010642215B1

(12) United States Patent
Li

(10) Patent No.: US 10,642,215 B1
(45) Date of Patent: May 5, 2020

(54) TONER DETECTION DEVICE OF WASTE TONER CONTAINER

(71) Applicant: GENERAL PLASTIC INDUSTRIAL CO., LTD., Taichung (TW)

(72) Inventor: Kuan-Tung Li, Taichung (TW)

(73) Assignee: GENERAL PLASTIC INDUSTRIAL CO., LTD., Taichung (TW)

( * ) Notice: Subject to any disclaimer, the term of this patent is extended or adjusted under 35 U.S.C. 154(b) by 0 days.

(21) Appl. No.: 16/438,019

(22) Filed: Jun. 11, 2019

(30) Foreign Application Priority Data

Feb. 13, 2019 (TW) ..... 108104859 A

(51) Int. Cl.
*G03G 21/10* (2006.01)
*G03G 21/16* (2006.01)
*G03G 21/12* (2006.01)

(52) U.S. Cl.
CPC ..... *G03G 21/105* (2013.01); *G03G 21/10* (2013.01); *G03G 21/12* (2013.01); *G03G 21/1647* (2013.01); *G03G 2221/1654* (2013.01); *G03G 2221/1657* (2013.01)

(58) Field of Classification Search
CPC ..... G03G 21/12; G03G 21/10; G03G 21/105; G03G 2221/1654; G03G 2221/1657; G03G 21/1647
See application file for complete search history.

(56) References Cited

U.S. PATENT DOCUMENTS 9,817,359 B2 11/2017 Kadowaki
2012/0163858 A1* 6/2012 Fujii ..... G03G 21/12 399/110
2018/0150020 A1* 5/2018 Yanase ..... G03G 15/0862
2019/0243299 A1* 8/2019 Furukawa ..... G03G 15/0865

* cited by examiner

*Primary Examiner* — Joseph S Wong
(74) *Attorney, Agent, or Firm* — Muncy, Geissler, Olds & Lowe, P.C.

(57) ABSTRACT

A toner detection device of a waste toner container having a housing includes a rotational wheel, a transmission member and a resilient member. The rotational wheel is rotatably disposed to the housing and provided with a first abutment portion. The transmission member including a second abutment position is connected with the rotational wheel in a way that the transmission member is rotatable with the rotational wheel and moveable relative to the rotational wheel between a first position and a second position. Two ends of the resilient member are respectively abutted against the first and second abutment portions in a way that the second abutment portion approaches the first abutment portion and the transmission member is rotatable relative to the rotational wheel with the transmission member moving from the first position to the second position.

13 Claims, 12 Drawing Sheets

TONER DETECTION DEVICE OF WASTE TONER CONTAINER

BACKGROUND OF THE INVENTION

1. Field of the Invention

The present invention relates generally to an electronic image-forming apparatus and more particularly, to a toner detection device of a waste toner container for being used in an electronic image-forming apparatus.

2. Description of the Related Art

A conventional electronic image-forming apparatus, such as photocopier or printer, is internally equipped with a replaceable waste toner container for collecting waste toner that is not transferred onto paper sheets. If the waste toner container is full of toner and is still being used in the electronic image-forming apparatus, the printing quality may deteriorate due to a leak of the waste toner. If a waste toner container under use is replaced by a new one in the condition that the waste toner container still has room for storing waste toner, this is a waste of money. Therefore, how to accurately detect whether the amount of the storage toner contained in the waste toner container reaches a predetermined level that a replacement of a new waste toner container shall be taken by a user is an issue that the manufacturers in this industry field need to solve.

A known solution is to install an optical sensor at a specific location of the waste toner container to directly detect whether the storage toner in the waste toner container is accumulative to a predetermined height level. However, misjudgment is liable to occur due to local accumulation of the storage toner. To solve the aforesaid problem, a waste toner container, which is equipped with a stirring shaft driven by a driven gear that is disposed inside the waste toner container and driven by the electronic image-forming apparatus for evenly distributing the storage toner inside the waste toner container, is developed.

To detect the amount of the storage toner, the above-mentioned waste toner container is further provided with a transmission member between the driven gear and the stirring shaft. Taking U.S. Pat. No. 9,817,359 for example, a driven gear 220 drives the stirring shaft 210, 230 to rotate through the transmission member 250. A biasing member 270 is disposed between the driven gear 220 and the transmission member 250. The transmission member 250 is provided with two resilient locking portions 251 each having an end with a wedge-shaped projection 253, and the driven gear 220 has two hole portions 222. With the increase of the amount of the storage toner inside the waste toner container 300, the rotational resistance of the stirring shaft 210, 230 increases. When the amount of the storage toner reaches a predetermined level, the stirring shaft 210, 230, which receives sufficient rotational resistance, will force the transmission member 250 to overcome the biasing force of the basing member 270 to move towards the driven gear 220. In the process of moving, the two resilient locking portions 251 of the transmission member 250 will be inwardly deformed to make the wedge-shaped projections 253 insert into the hole portions 222 first. After the transmission member 250 is moved to a desired position, the two resilient locking portions 251 rebound outwardly to mark the wedge-shaped projections 253 engage with the hole portions 222 to limit the transmission member 250 in that position and to disengage the stirring shaft 210, 230 from the transmission member 250. At this moment, a flag member 280, which is linked with the transmission member 25, protrudes over a surface of the waste toner container 300, such that the flag member 280 can be detected by the electronic image-forming apparatus 1 and a warning signal indicative of full of storage toner inside the waste toner container is announced.

According to the above-mentioned structure, the transmission member 250 may be forced to move to the desired position only when the condition that the rotational resistance of the stirring shaft 210, 230, which is generated at the time the amount of the storage toner reaches a predetermined level, is greater enough to overcome the sum of the biasing force of the biasing member 270, the biasing force of the locking portions 251 and the friction force between the wedge-shaped projections 253 and the hole portions 222 is fulfilled. However, the tolerance, conditions, environment, and material of manufacturing will affect the aforesaid biasing and friction forces and quality stability of the waste toner container. A minor error of these manufacturing parameters may affect the maximum capacity of the waste toner container, resulting in leak of toner or announcement of false warning signal indicative of replacement of a non-full waste toner container to cause waste of money. To have uniform quality of products, the manufacturing parameters must be strictly and accurately controlled, thereby increasing manufacturing cost.

SUMMARY OF THE INVENTION

The present invention has been accomplished in view of the above-noted circumstances. It is an objective of the present invention to provide a toner detection device of a waste toner container, which can accurately detect whether an amount of the storage toner in the waste toner container reaches a predetermined level. Another objective of the present invention is to provide a toner detection device of a waste toner container, which can enhance structural stability and reduce the manufacturing cost thereof.

To attain the above objectives, the present invention provides a toner detection device of a waste toner container comprising a rotational wheel, a transmission member and a resilient member. The waste toner container includes a housing, to which the rotational wheel is adapted to be rotatably installed. The rotational wheel is provided with a first abutment portion. The transmission member is connected with the rotational wheel in a way that the transmission member is rotatable with the rotational wheel and moveable relative to the rotational wheel between a first position and a second position. The transmission member includes a second abutment portion. The resilient member is disposed between the rotational wheel and the transmission member and has two ends abutted respectively against the first and second abutment portions in a way that the resilient member imparts a biasing force exerting on the transmission member towards the first position. The second abutment portion approaches the first abutment portion and the transmission member is rotatable relative to the rotational wheel with the transmission member moving from the first position to the second position.

By means of the aforesaid structural features, the toner detection device of the waste toner container can accurately detect whether the amount of the storage toner in the waste toner container reaches a predetermined level, enhance the structural stability thereof, and reduce the manufacturing cost thereof.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
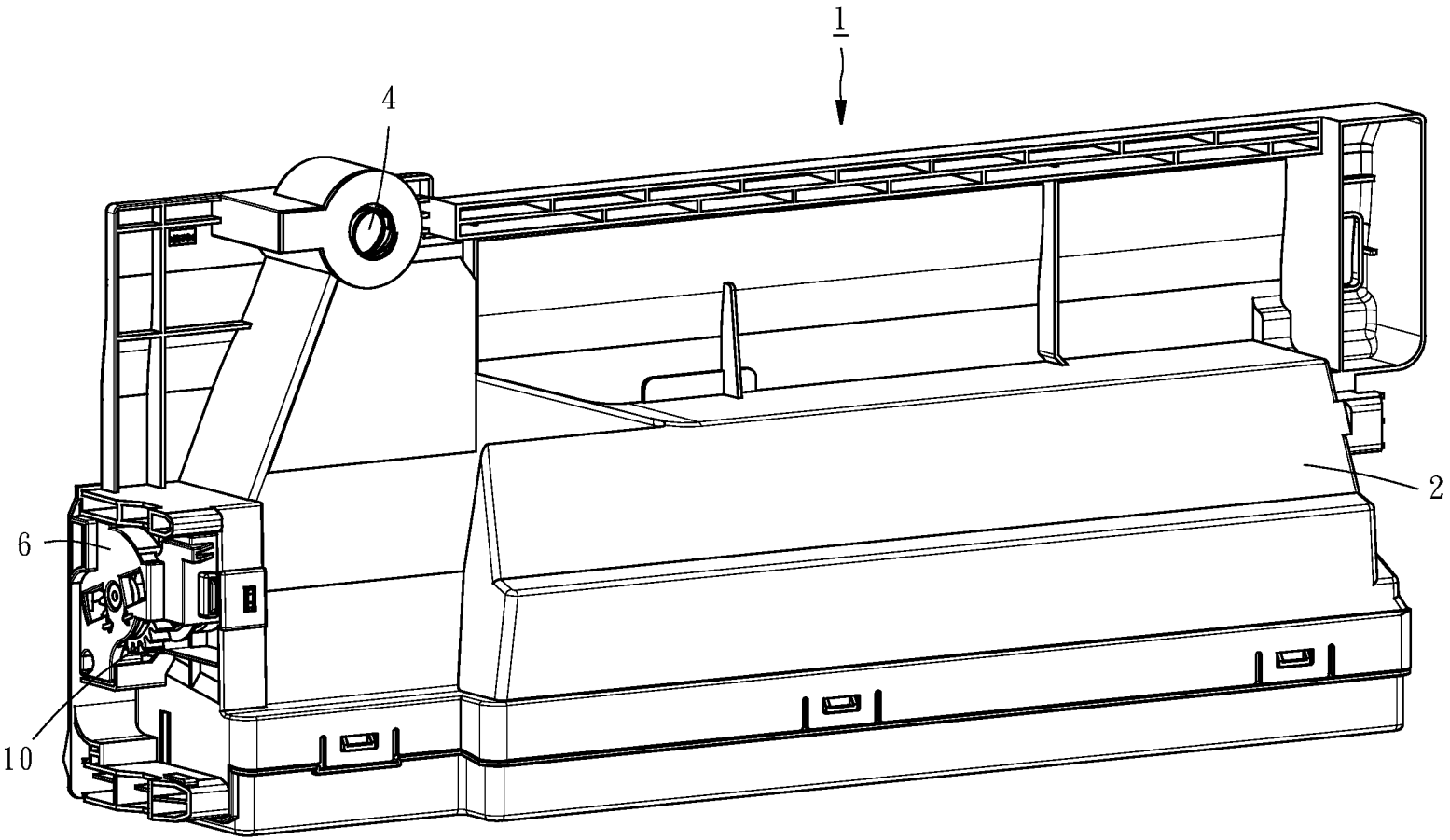
FIG. 1 is a perspective view of a waste toner container according to a first embodiment of the present invention.
Figure 2:
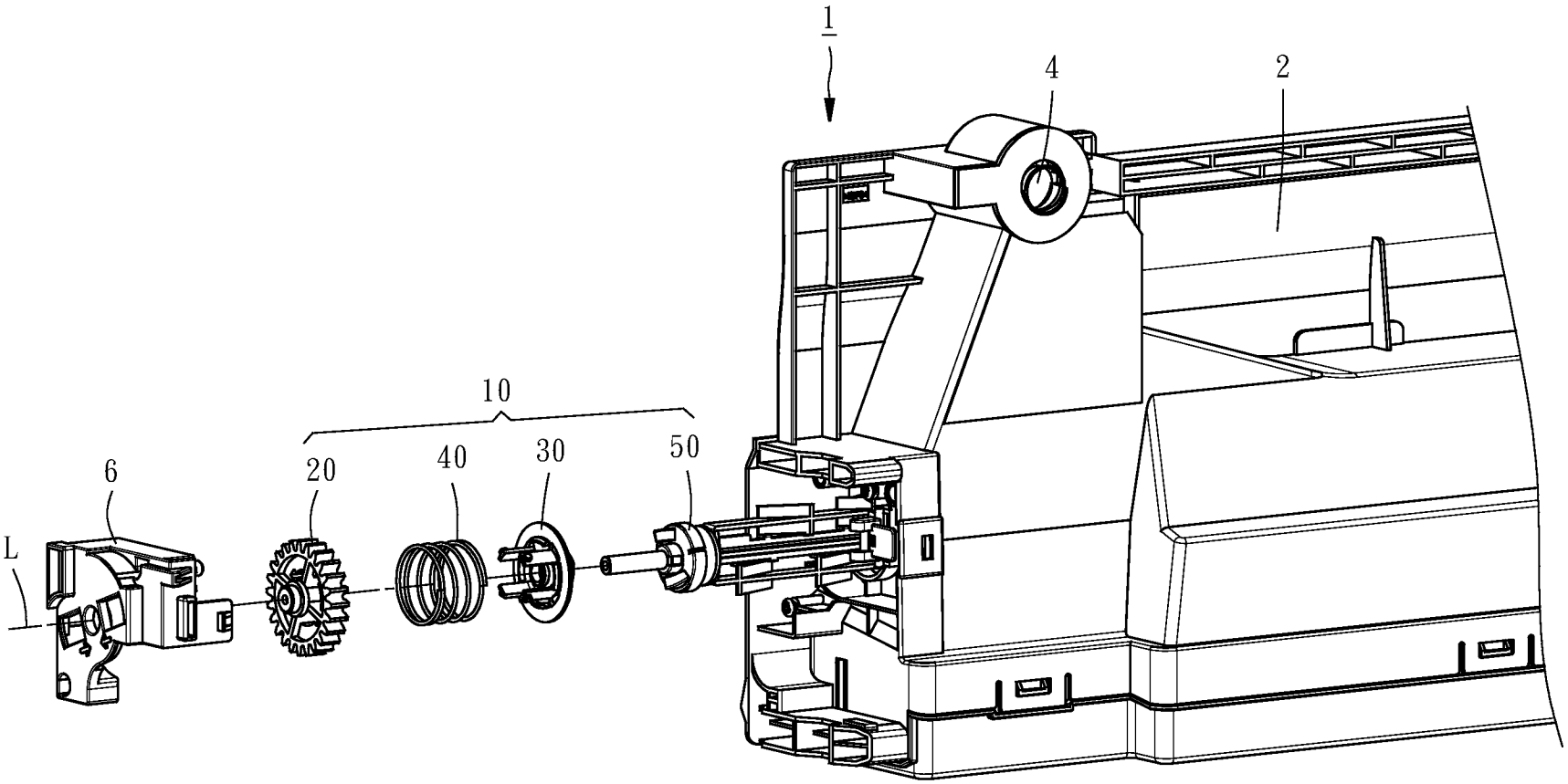
FIG. 2 is an exploded perspective view of a part of the waste toner container of the first embodiment.

Hereunder two embodiments will be detailedly described with accompanying drawings for illustrating technical features and structure of the present invention. FIGS. 1 and 2 are perspective views showing that a waste toner container 1 is equipped with a toner detection device 10 in accordance with a first embodiment of the present invention. The waste toner container 1 is adapted to be installed in an electronic image-forming apparatus (not shown), such as photocopies, printer, etc. The electronic image-forming apparatus comprises a power source (not shown) adapted to be connected with a rotational wheel 20, and a sensor (not shown). The waste toner container 1 is composed of a housing 2 provided at a top thereof with an entrance 4, a lateral cover 6 mounted to a side of the housing 2, and the toner detection device 10 disposed in between the housing 2 and the lateral cover 6. The entrance 4 allows waste toner to enter the waste toner container 1 of the image-forming apparatus. The sensor is configured to detect activity of the toner detection device 10.

Figure 3:
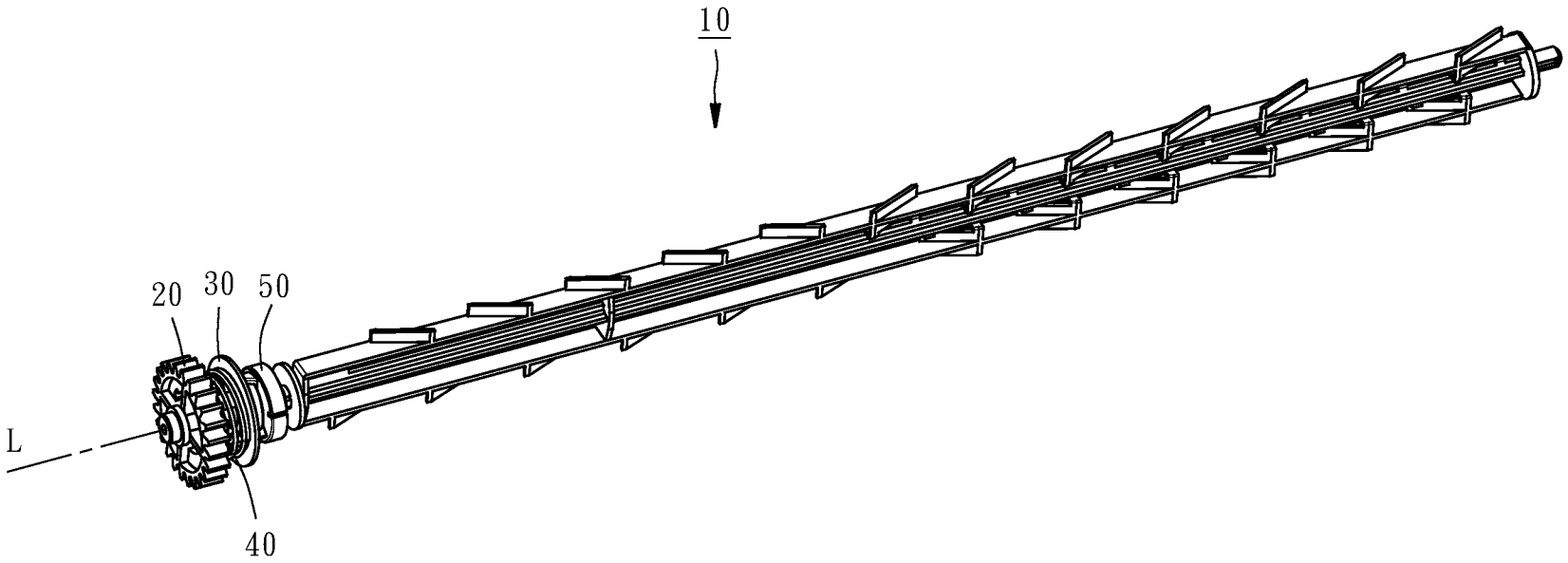
FIG. 3 is a perspective view of a toner detection device of the waste toner container according to the first embodiment of the present invention.

FIG. 3 is a perspective view of a toner detect device 10 in accordance with a first embodiment of the present invention. In this embodiment, the toner detection device 10 is composed of a rotational wheel 20, a transmission member 30, a resilient member 40, and a stirring shaft 50.

Figure 4B:
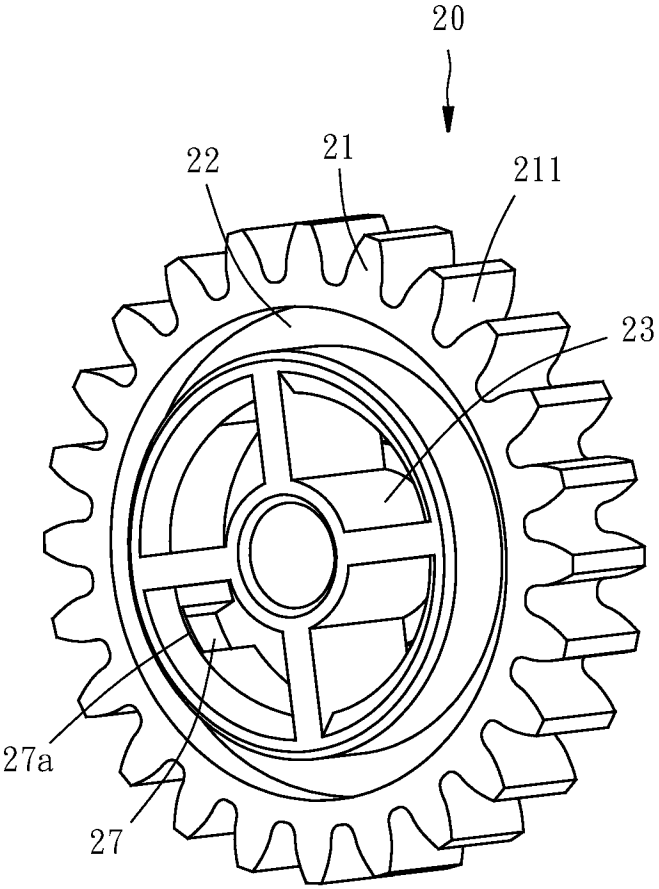
FIG. 4B is another perspective view of the rotational wheel of the toner detection device of the first embodiment.
Figure 4A:
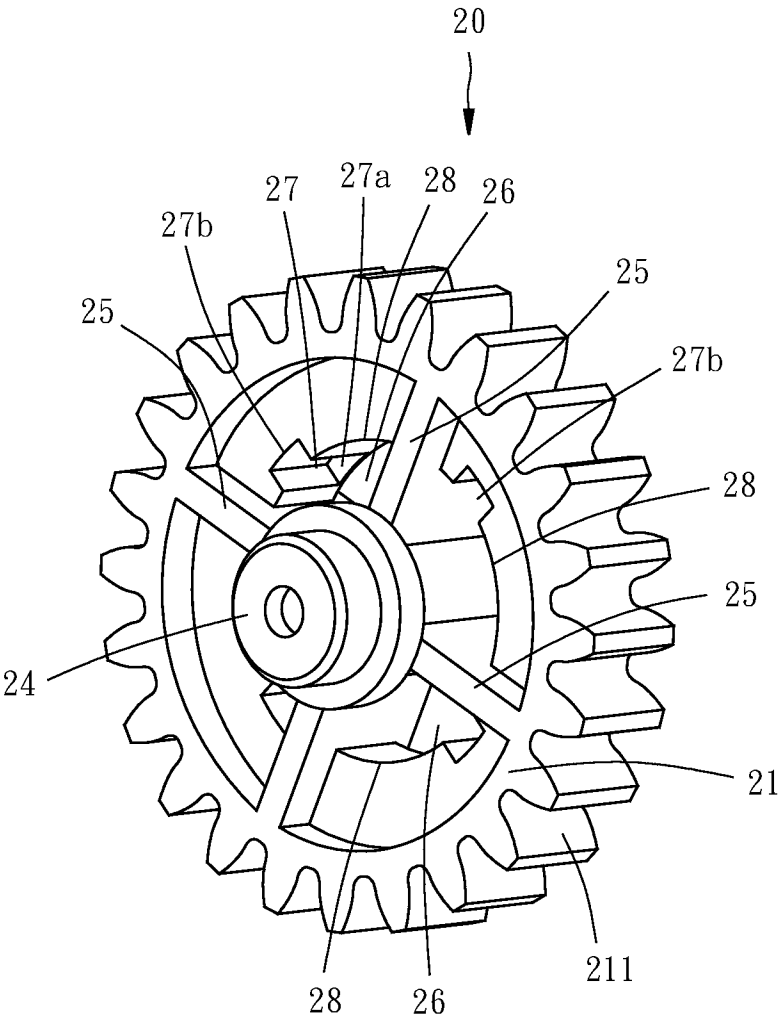
FIG. 4A is a perspective view of a rotational wheel of the toner detection device of the first embodiment.

As shown in FIGS. 4A and 4B, the rotational wheel 20 is rotatably installed in the housing 2 in such a way that the rotational wheel 20 can be driven by the power source to rotate about an imaginary axis L relative to the housing 2. The rotational wheel 20 comprises an annular main body 21, a first abutment portion 22 facing the transmission member 30 and configured as an annular groove, a tube portion 23 located at a center of the main body 21 and parallel to the imaginary axis L, a bottom portion 24 provided at an end of the tube portion 23 that is remote from the transmission member 30, four stop walls 25 extending radially from the tube portion 23 to the main body 21, four hollow portions 26 each located between two adjacent stop walls 25, four axial sliding grooves 27 provided at an inner periphery of the main body 21 and each located adjacent to one of the hollow portions 26, and four contact portions 28 provided at the inner periphery of the main body 21 and each located adjacent to one of the hollow portions 26. The outer periphery of the main body 21 is provided with a tooth portion 211 adapted to be engaged with the power source. The hollow portions 26 are located between the tube portion 23 and the main body 21, and each of the contact portions 28 is located between paired one axial sliding groove 27 and one stop wall 25. Each axial sliding groove 27 extends along a direction parallel to the imaginary axis L and has a stop portion 27*a* adjacent to the transmission member 30, and an exit 27*b* remote from the transmission member 30.

Figure 5B:
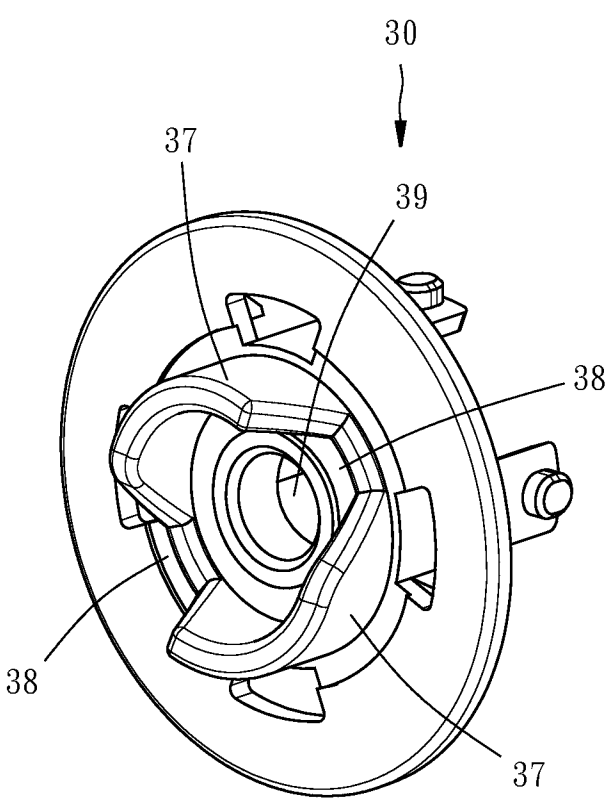
FIG. 5B is another perspective view of the transmission member of the toner detection device of the first embodiment.
Figure 5A:
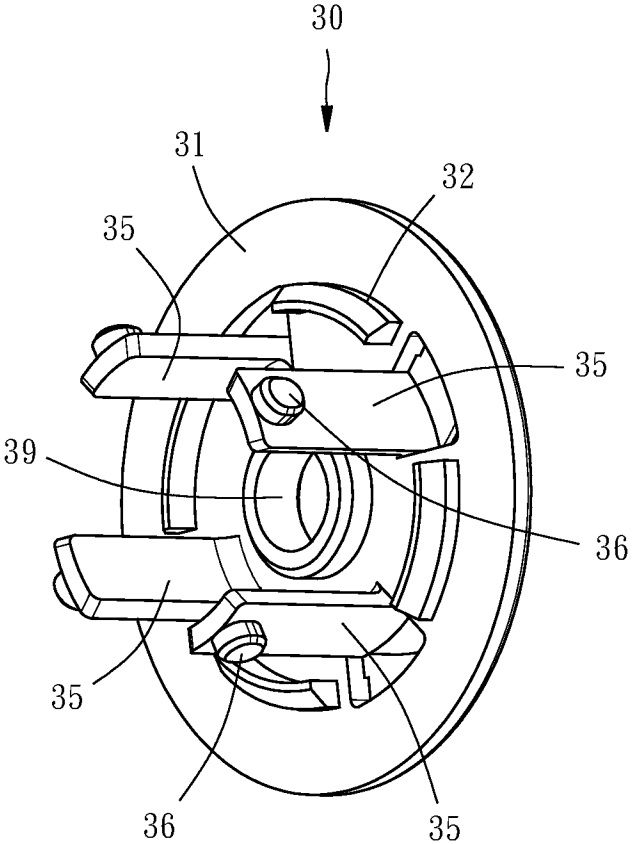
FIG. 5A is a perspective view of a transmission member of the toner detection device of the first embodiment.

As shown in FIGS. 5A and 5B, the transmission member 30 includes a plate-like main body 31, four arms 35 extending from the main body 31 toward the rotational wheel 20, four protrusion blocks 36, each of which is disposed at an outer surface of a terminal of one of the four arms 35, two protrusion portions 37 extending from the main body 31 toward a direction away from the rotational wheel 20, two engagement notches 38 each formed between the two protrusion portions 37, and a through hole 39 penetrating through the main body 31 along the imaginary axis L. The main body 31 is provided with an annular second abutment portion 32 facing the rotational wheel 20. The four arms 35 are inserted into the hollow portions 26, respectively, in such a way that each protrusion block 36, which protrudes radially from the respective arm 35, is inserted into one of the axial sliding grooves 27. As such, the transmission member 30 is synchronously and coaxially rotatable with the rotational wheel 20. The stop portions 27*a* of the rotational wheel 20 can prevent the protrusions blocks 36 from escape from the axial sliding grooves 27 along a direction away from the rotational wheel 20.

The resilient member 40 is realized in this embodiment as a cylindrical coil spring having two ends abutted against the first abutment portion 22 of the rotational wheel 20 and the second abutment portion 32 of the transmission member 30 in a way that the transmission member 30 and the rotational member 20 are forced by the resilient member 40 to move away from each other when they receive no external force. Modification to the shape of the resilient member 40 may be used in other embodiment as long as the two ends thereof are abutted against the rotational wheel 20 and the transmission member 30.

Figure 6:
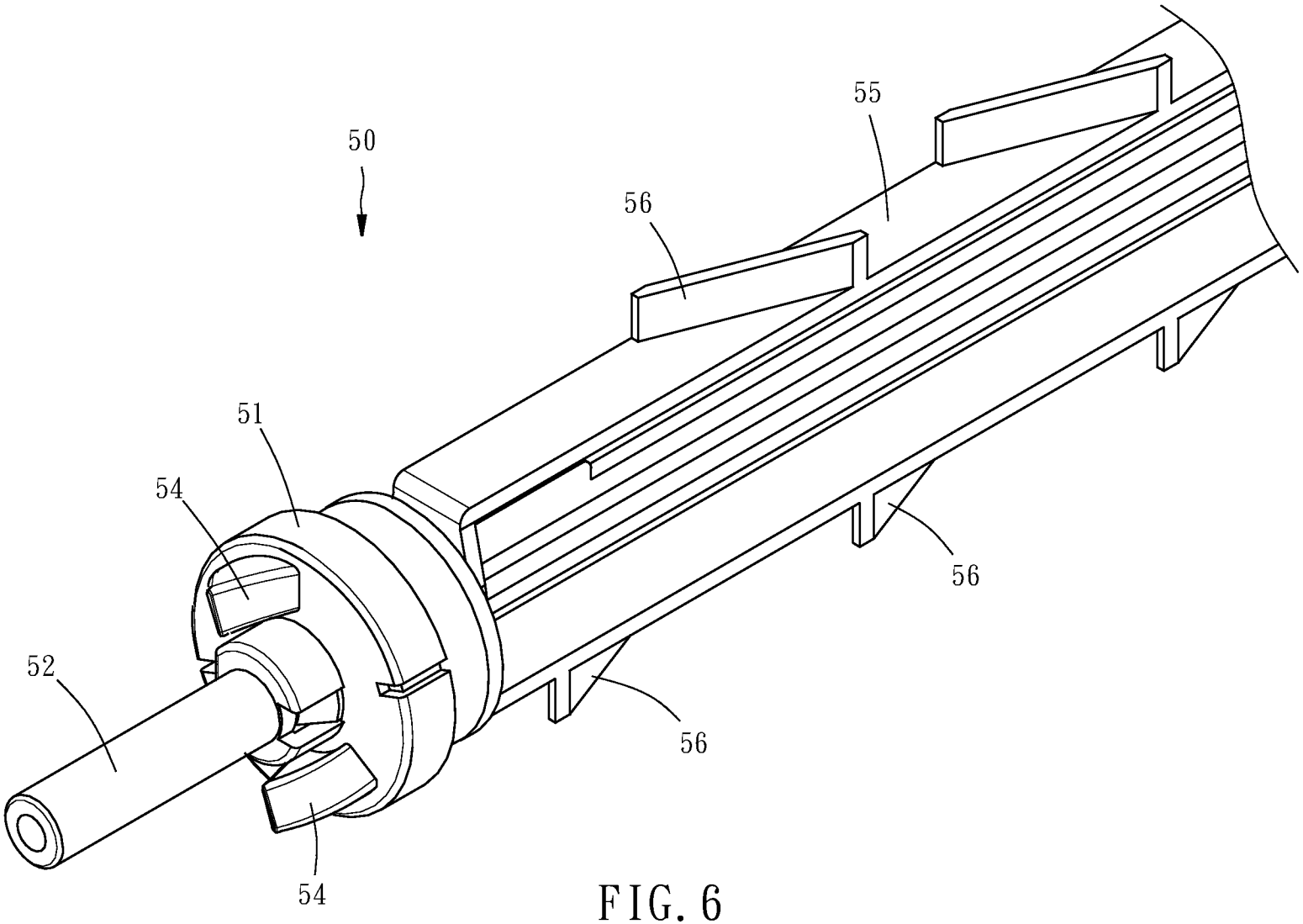
FIG. 6 is a perspective view of a part of a stirring shaft of the toner detection device of the first embodiment.

As shown in FIG. 6, the stirring shaft 50 includes a connecting portion 51 engageable with the transmission member 30, and a stirring portion 55 engaged with the connecting portion 51 such that the stirring portion 55 is rotatable along with the connecting portion 51. The connecting portion 51 has an axle 52 and two axially extending teeth 54. The axle 52 is inserted through the through hole 39 of the transmission member 30 into the tube portion 23 of the rotational wheel 20 in a way that the terminal end of the axle 52 is in contact with the bottom portion 24, thereby restricting the stirring shaft 50 in a desired position. Each of the teeth 54 is inserted into one of the engagement notches 38 of the transmission member 30, such that the stirring shaft 50 is engaged with the transmission member 30 and rotatable along with the transmission member 30. The stirring portion 55 has a plurality of blades 56. When the stirring portion 55 is rotated along with the connecting portion 51, the blades 56 stir the storage toner in the waste toner container so as to distribute the storage toner evenly in the waste toner container 1. The connecting portion 51 and the stirring portion 55 may be configured as one unitary component or two individual components as they are in this embodiment.

Figure 7C:
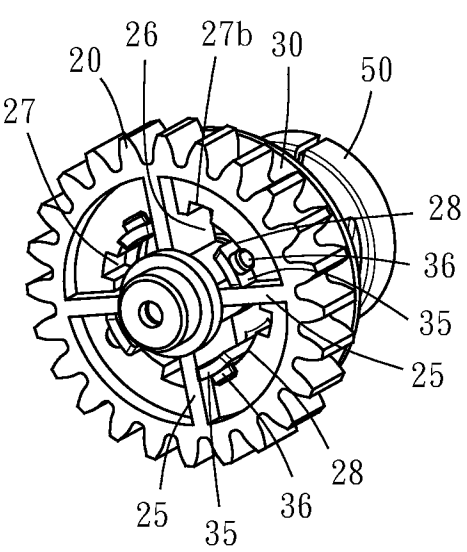
FIGS. 7A to 7C are schematic views showing movements of the transmission member of the first embodiment.
Figure 7B:
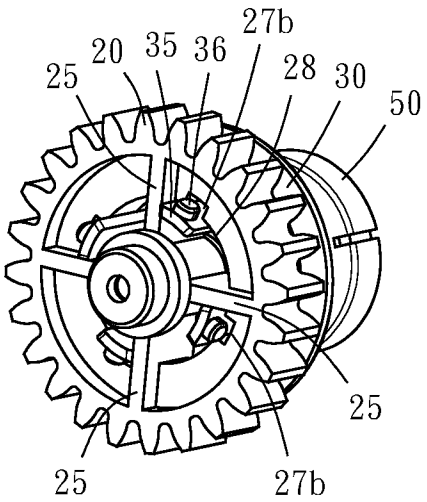
Figure 7A:
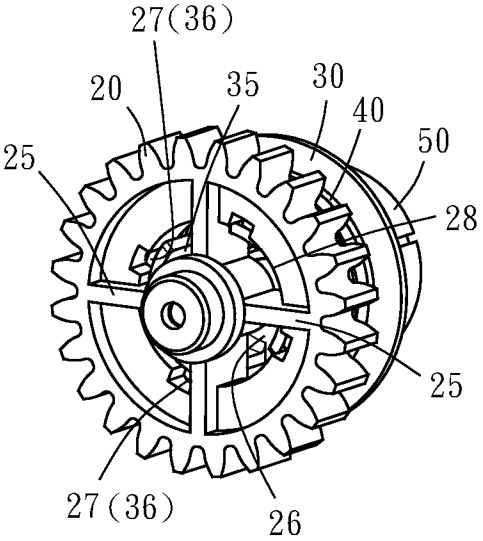
Figure 8:
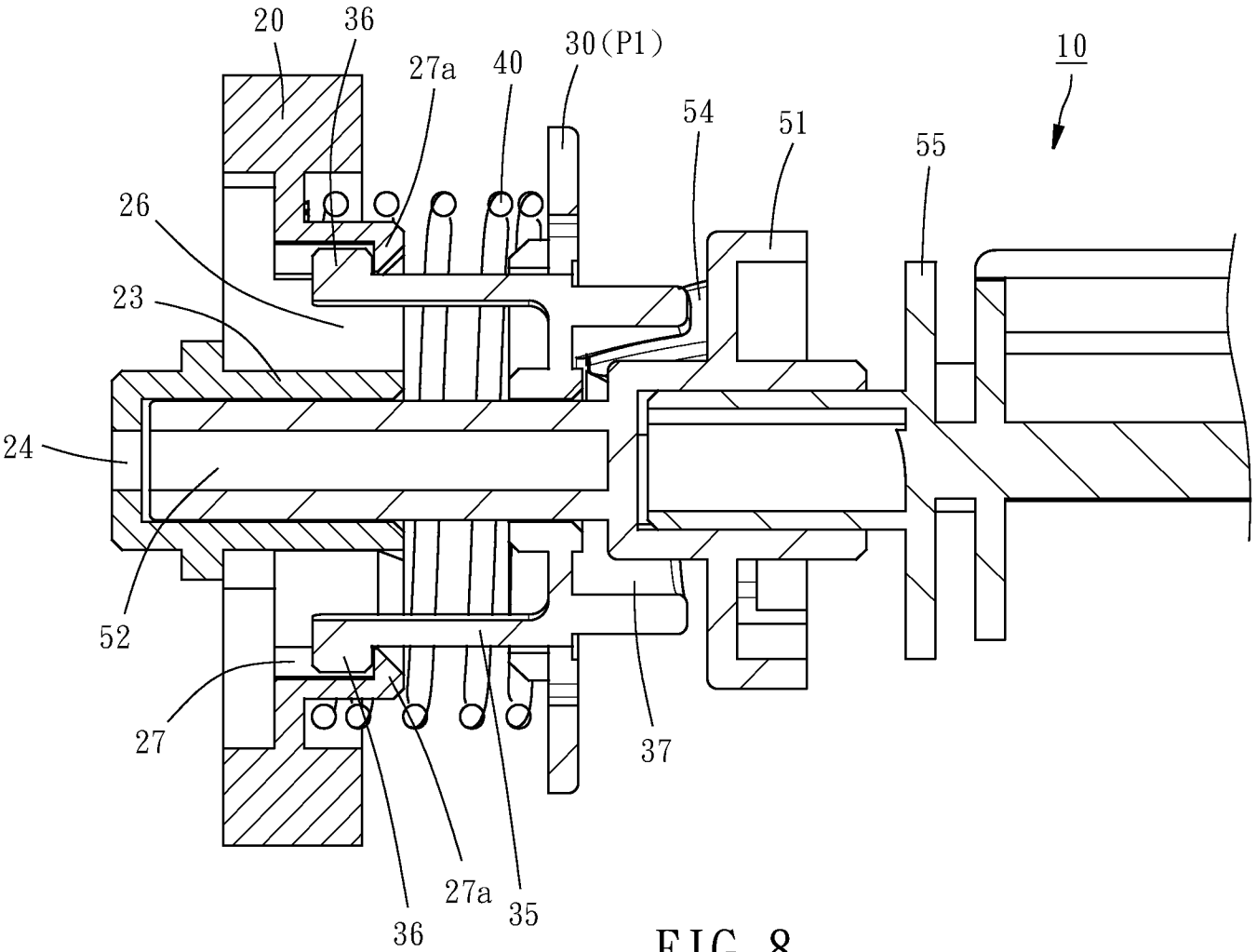
FIG. 8 is a sectional view showing the transmission member of the first embodiment is located at a first position.
Figure 9:
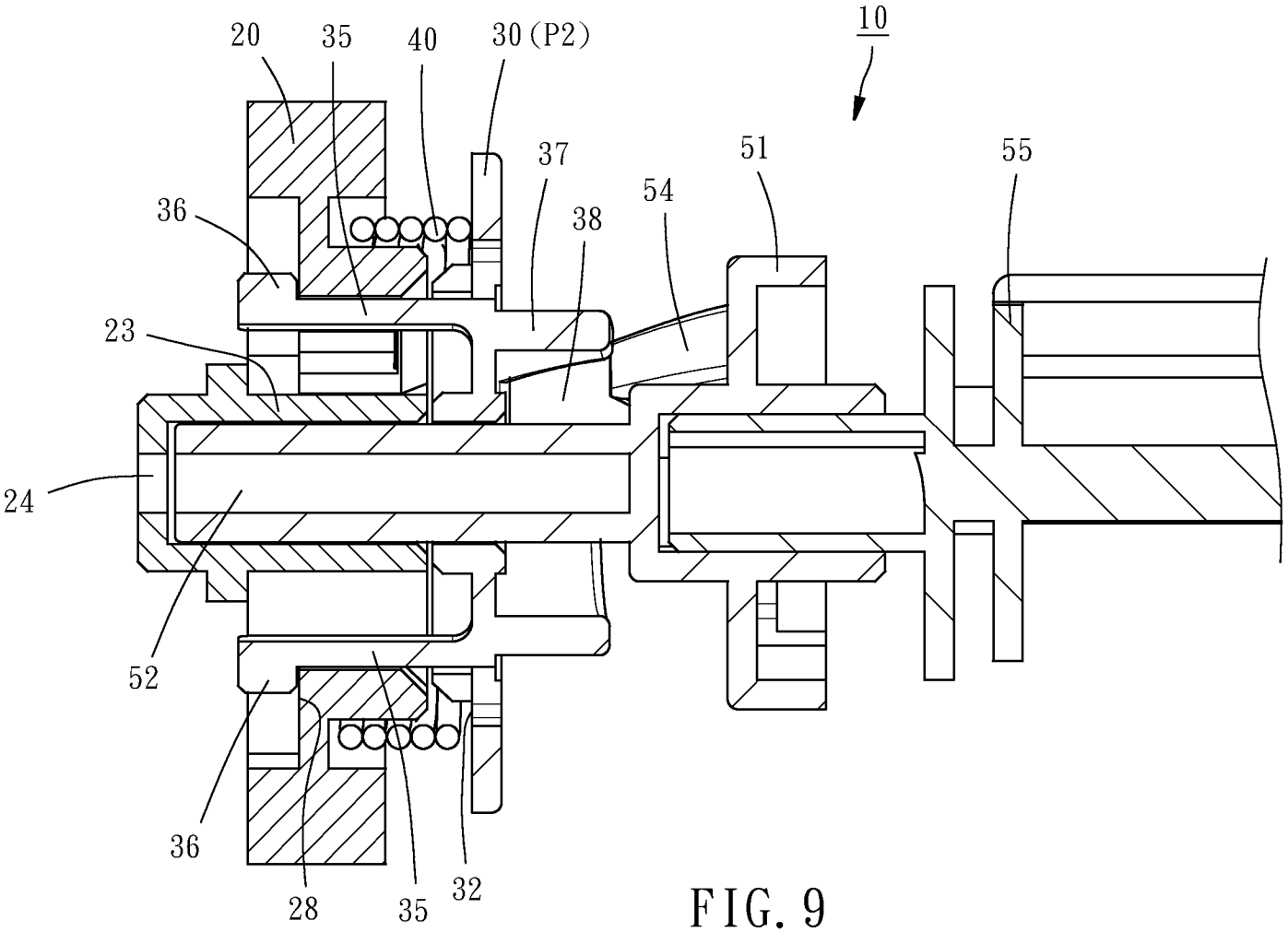
FIG. 9 is a sectional view showing the transmission member of the first embodiment is located at a second position.

With the above-mentioned structural design, the transmission member 30 is moveable relative to the rotational wheel 20 between a first position P1, as shown in FIG. 8, and a second position P2, as shown in FIG. 9. Since the resilient member 40 imparts a biasing force exerting on the transmission member 30 towards the first position P1, the transmission portion 30 will stay at the first position P1 when it receives no external force. As shown in FIGS. 7A and 8, when the transmission member 30 stays at the first position P1, the two teeth 54 are inserted into the engagement notches 38 respectively, resulting in that the stirring shaft 50 is engaged with the transmission member 30 and can thus be driven by the transmission member 30, which is in turn driven by the rotational wheel 20, to rotate. That is, the stirring shaft 50 can be indirectly driven by the rotational wheel 20 to rotate via the transmission member 30. With the increase of the amount of the storage toner in the waste toner container 1, the rotational resistance against the stirring shaft 50 increases, resulting in that the teeth 54 and the engagement notches 38 become gradually displaced from each other and the reacting force exerting on the transmission member 30 overcomes the biasing force of the resilient member 40 to push the transmission member 30 towards the second position P2. At this state, the second abutment portion 332 gradually and moveably approaches the first abutment portion 22 in a manner that the stirring shaft 50 can be still driven by the transmission member 30 to rotate. As the storage toner in the waste toner container 1 reaches a predetermined amount, i.e. the rotational resistance against the stirring shaft 50 reaches a threshold value, the transmission member 30 will be pushed to a position closest to the rotational wheel 20. At this moment, the protrusion blocks 36 escape from the axial sliding grooves 27 via the exits 27*b*, as shown in 7B. As soon as the protrusion blocks 36 escape from the axial sliding grooves 27, the transmission member 30 will rotate at an angle relative to rotational wheel 20 due to the action of the stirring shaft 50, or from another viewing reference the rotational wheel 20 will rotate at an angle relative to the transmission member 30, such that the protrusion blocks 36 will move along the contact portions 28 until the arms 35 of the transmission member 30 respectively stop at the stop walls 25, as shown in FIG. 7C, resulting in that the transmission member 30 can be driven by the rotational wheel 20 to rotate again. At this moment, the two teeth 54 escape from the engagement notches 38 and the transmission member 30 is maintained at the second position P2 because the protrusion blocks 36 of the transmission member 30 are abutted against the contact portions 28, such that the stirring shaft 50 can no longer be driven by the transmission member 30 to rotate, i.e. the rotational wheel 20 can no longer drive the stirring shaft 50 to rotate via the transmission member 30. As soon as the transmission member 30 is moved to the second position P2, it will be detected by the sensor to enable the electronic image-forming apparatus to announce a warning signal indicative of a sign that the waste toner container needs to be replaced.

With the above-mentioned structural features, as long as the stirring shaft 50 overcomes the biasing force of the resilient member 40, the stirring shaft 50 will push the transmission member 30 to move from the first position P1 to the second position P2 when the amount of the storage toner in the waste toner container reaches a predetermined level. Because the biasing force of the resilient member can be easily set and the manufacturing conditions, minor dimension error and materials of other components, such as the rotational wheel 20 and the transmission member 30, will not affect the maximum capacity of the waste toner container 1, the waste toner container 1 may have a good stability of quality, and a uniform quality of the waste toner container can be achieved without the need of strictly controlling the manufacturing parameters, thereby reducing the manufacturing cost and achieving the effect of accurately detecting whether the amount of the storage toner in the waste toner container has reached a predetermined level.

It is worth mentioning that one or more stop walls 25, hollow portions 26, axial sliding grooves 27, contact portions 28 of the rotational wheel 20, one or more arms 35, protrusion blocks 36 on the arms 35, engagement notches 38 of the transmission member 30, and one or more teeth 54 of the stirring shaft 50 may be used in the present invention. That is, the numbers of the aforesaid components are not limit to the ones disclosed in this embodiment. Further, the rotational wheel 20 may be configured without the tooth portion 211 as long as the rotational wheel 20 can be driven by the power source to rotate. Furthermore, the sensor of the electronic image-forming apparatus is not a key feature of the present invention as long as the electronic image-forming apparatus can detect movement of the transmission member 30.

Figure 10:
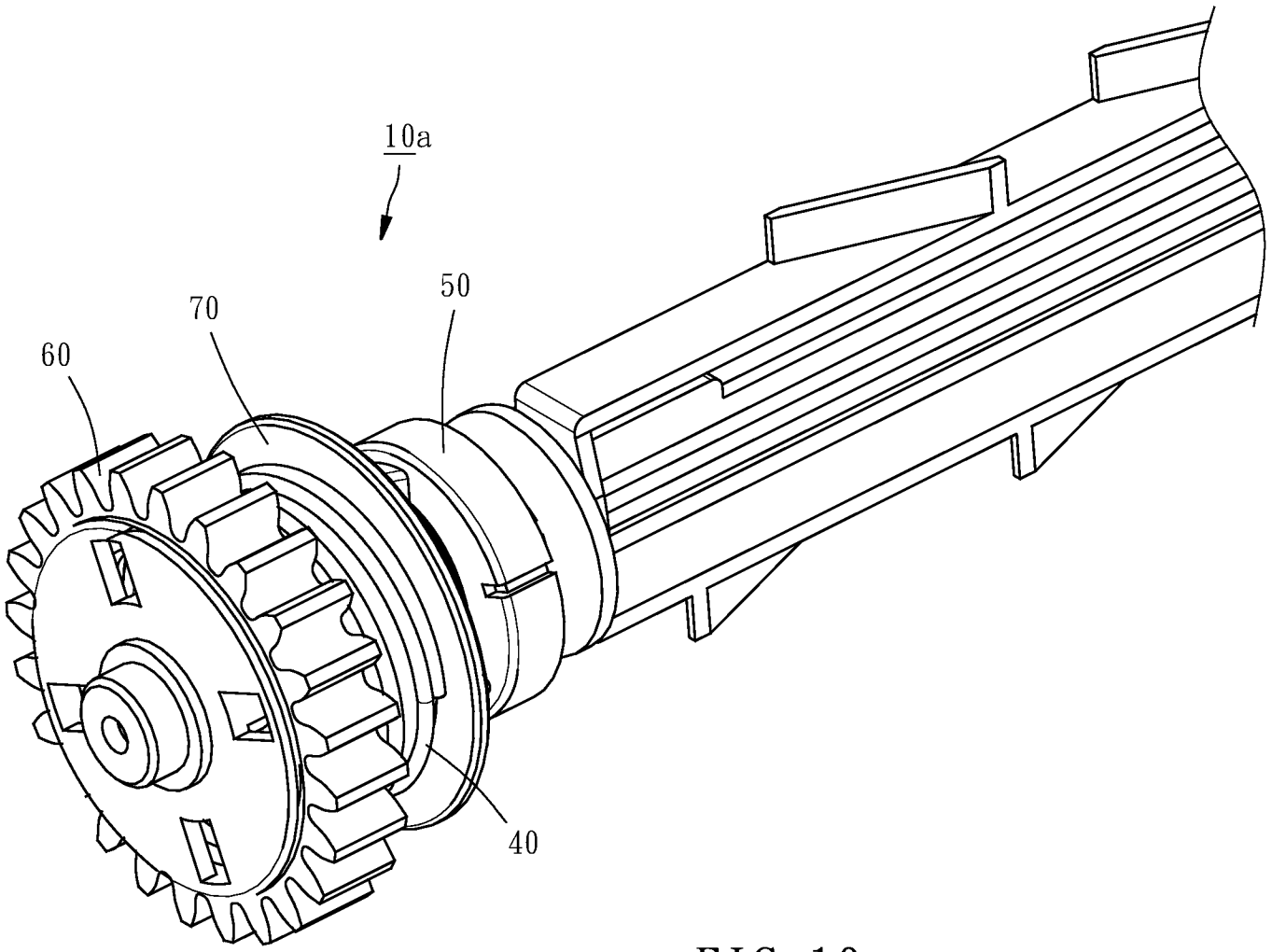
FIG. 10 is a perspective view of a part of a toner detection device of a waste toner container according to a second embodiment of the present invention.
Figure 11B:
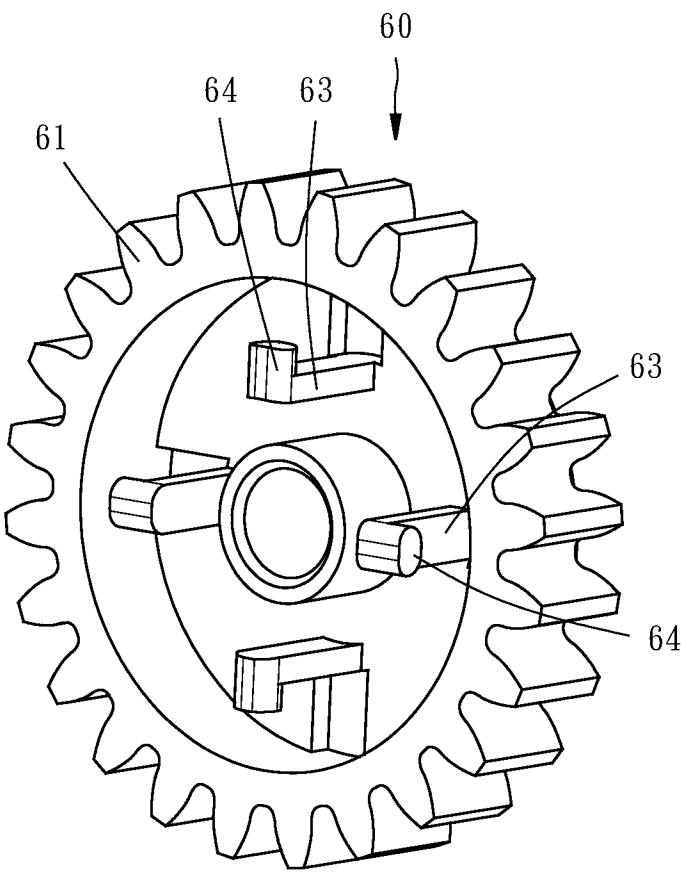
FIG. 11B is another perspective view of the rotational wheel of the toner detection device of the second embodiment.
Figure 11A:
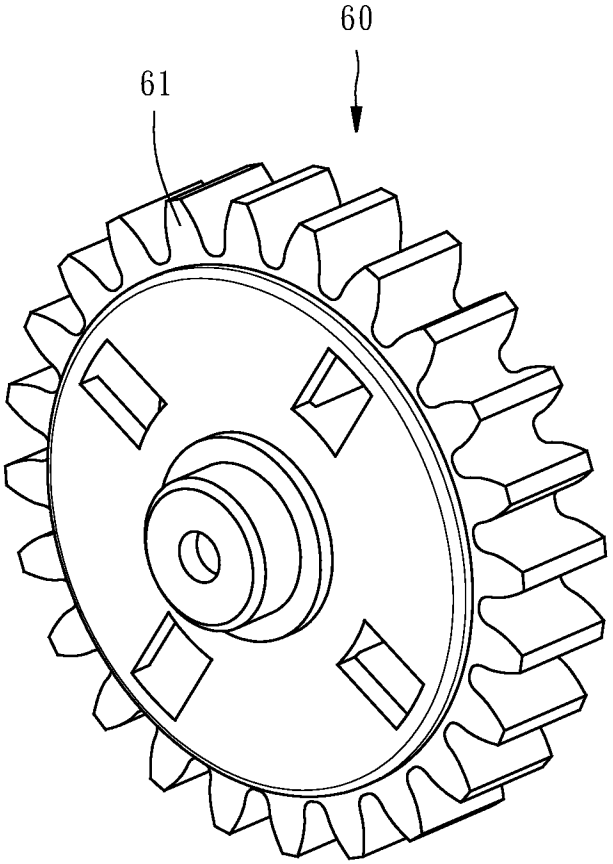
FIG. 11A is a perspective view of a rotational wheel of the toner detection device of the second embodiment.
Figure 12B:
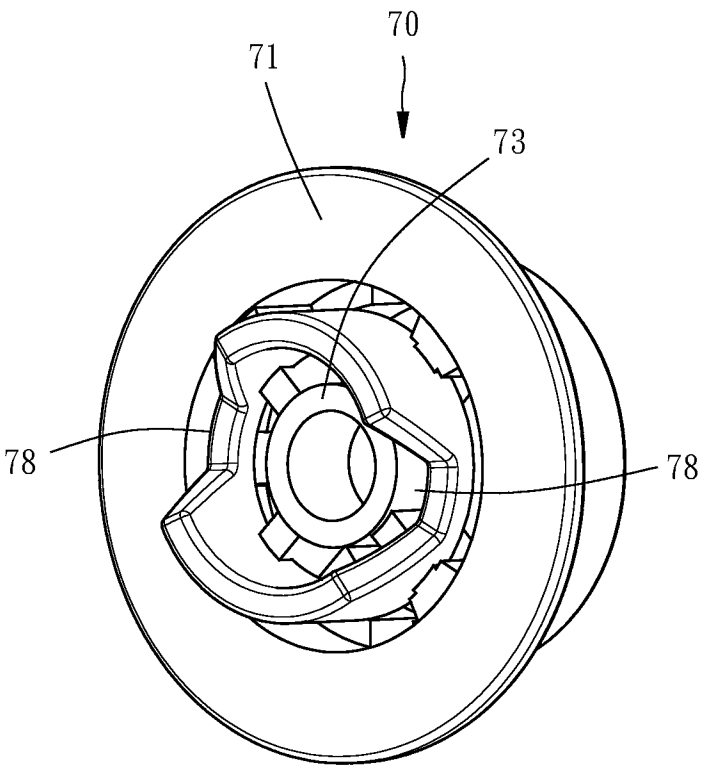
FIG. 12B is another perspective view of the transmission member of the toner detection device of the second embodiment.
Figure 12A:
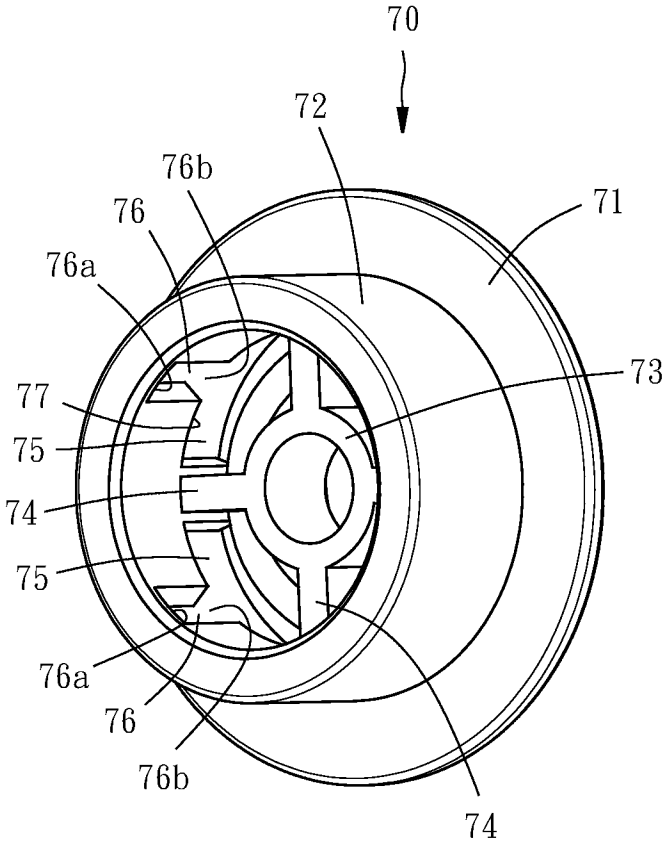
FIG. 12A is a perspective view of a transmission member of the toner detection device of the second embodiment.

Based on the above-mentioned technical features, various modifications to the structure of the toner detection device 10 may be made. For example, FIG. 10 shows a toner detection device 10*a* according to a second embodiment of the present invention, in which the coupling structures of the rotational wheel 20 and the transmission member 30 are mainly exchanged from one to another compared to the toner detection device 10 of the first embodiment of the present invention. Specifically, in this embodiment, the rotational wheel 60 includes a main body 61, four arms 63 extending from the main body 61, four protrusion blocks 64, each of which is disposed on one of the four arms 63, as shown in FIGS. 11A and 11B. Further, as shown in FIGS. 12A and 12B, the transmission member 70 includes a main body 71, a barrel portion 72 extending from the main body 71, a tube portion at a center of the main body 71 with a through hole 73, four stop walls 74 extending radially from the tube portion to the barrel portion 72, four hollow portions 75 each located between two adjacent stop walls 74, four axial sliding grooves 76 provided at an inner periphery of the barrel portion 72 and each located adjacent to one of the hollow portions 75, four contact portions 77 provided at the inner periphery of the barrel portion 72 and each located adjacent to one of the hollow portions 75, and two engagement notches 78 facing the stirring shaft 50. Each axial sliding groove 76 has a stop portion 76*a* adjacent to the rotational wheel 60, and an exit 76*b* remote from the rotational wheel 60. The arms 63 of the rotational wheel 60 are inserted into the hollow portions 75 of the transmission member 70, respectively, in such a way that each protrusion block 64 is inserted into one of the axial sliding grooves 76. As such, the transmission member 70 is synchronously rotatable with the rotational wheel 60. With the aforesaid structural design, the transmission member 70 is also moveable between the first position P1 and the second position P2 relative to the rotational wheel 60.

When the transmission member 70 is located at the first position P1, the stop portions 76*a* of the transmission member 70 can prevent the protrusion blocks 64 of the rotational wheel 60 from escape from the axial sliding grooves 76. Each of the teeth 54 of the stirring shaft 50 is inserted into one of the engagement notches 78 of the transmission member 70, such that the stirring shaft 50 is engaged with the transmission member 70 and rotatable along with the rotational wheel 60. When the amount of the storage toner in the waste toner container 1 gradually reaches the predetermined level, the transmission member 70 is gradually pushed to move from the first position P1 to the second position P2 until the protrusion blocks 64 escape from the axial sliding grooves 76 via the exits 76*b*. Thereafter, the transmission member 70 will rotate at an angle relative to rotational wheel 60 due to the action of the stirring shaft 50 until the arms 63 respectively stop at the stop walls 74, resulting in that the transmission member 70 is retained at the second position P2 and the transmission member 70 can be driven by the rotational wheel 60 to rotate again. As a result, the toner detection device 10*a* can also achieve the effects of stabile quality and low manufacturing cost.

The invention being thus described, it will be obvious that the same may be varied in many ways. For example, in the first embodiment, the axial sliding grooves 27 and the contact portions 28 may be provided at the outer periphery of the tube portion 23, and the protrusion blocks 36 radially extend from the arms 35 inwardly. Further, in the second embodiment, when the transmission member 70 is pushed to move to the second position P2, the arms 63 are figured not being abutted against the stop walls 74 but the protrusion blocks 64 of the rotational wheel 60 are abutted against other parts of the transmission member 70. That is, the present invention can be designed in a way that when the transmission member 70 is located at the second position P2, a specific part of the rotational wheel 60 will be abutted by a specific part of the transmission member 70 to result in that the transmission member 70 can rotate along with the rotational wheel 60. Such variations are not to be regarded as a departure from the spirit and scope of the invention, and all such modifications as would be obvious to one skilled in the art are intended to be included within the scope of the following claims.

What is claimed is:

1. A toner detection device of a waste toner container having a housing, the toner detection device comprising:

a rotational wheel for being rotatably installed in the housing, the rotational wheel including a first abutment portion;

a transmission member connected with the rotational wheel in a way that the transmission member is rotatable with the rotational wheel and moveable relative to the rotational wheel between a first position and a second position, the transmission member including a second abutment portion; and a resilient member disposed between the rotational wheel and the transmission member and having two ends abutted respectively against the first and second abutment portions in a way that the resilient member imparts a biasing force exerting on the transmission member towards the first position;

wherein the second abutment portion approaches the first abutment portion and the transmission member is rotatable relative to the rotational wheel while the transmission member is moving from the first position to the second position.

2. The toner detection device of the waste toner container as claimed in claim 1, wherein the rotational wheel comprises an axial sliding groove; the transmission member comprises a protrusion block inserted into the axial sliding groove, such that the transmission member is rotatable along with the rotational wheel.

3. The toner detection device of the waste toner container as claimed in claim 2, wherein the axial sliding groove of the rotational wheel has a stop portion adjacent to the transmission member, and an exit remote from the transmission member; the protrusion block escapes from the axial sliding groove via the exit when the transmission member is moved from the first position to the second position.

4. The toner detection device of the waste toner container as claimed in claim 3, wherein the rotational wheel comprises a hollow portion located by the axial sliding groove; the transmission member comprises an arm extending into the hollow portion and being provided with the protrusion block.

5. The toner detection device of the waste toner container as claimed in claim 4, wherein the rotational wheel comprises a contact portion located by the hollow portion; the protrusion block of the transmission member is contactable with the contact portion of the rotational wheel to retain the transmission member at the second position.

6. The toner detection device of the waste toner container as claimed in claim 5, wherein the rotational wheel comprises a stop wall located by the hollow portion and configured to be abutted by the transmission member in a way that the transmission member is rotatable along with the rotational wheel when the transmission member is located at the second position.

7. The toner detection device of the waste toner container as claimed in claim 1, wherein the transmission member comprises an axial sliding groove; the rotational wheel comprises a protrusion block inserted into the axial sliding groove, such that the transmission member is rotatable along with the rotational wheel.

8. The toner detection device of the waste toner container as claimed in claim 7, wherein the axial sliding groove of the transmission member has a stop portion adjacent to the rotational wheel, and an exit remote from the rotational wheel; the protrusion block escapes from the axial sliding groove via the exit when the transmission member is moved from the first position to the second position.

9. The toner detection device of the waste toner container as claimed in claim 8, wherein the transmission member comprises a hollow portion located by the axial sliding groove; the rotational wheel comprises an arm extending into the hollow portion and being provided with the protrusion block.

10. The toner detection device of the waste toner container as claimed in claim 9, wherein the transmission member comprises a contact portion located by the hollow portion; the protrusion block of the rotational wheel is contactable with the contact portion of the transmission member to retain the transmission member at the second position.

11. The toner detection device of the waste toner container as claimed in claim 10, wherein the transmission member comprises a stop wall located by the hollow portion and configured to be abutted by the rotational wheel in a way that the transmission member is rotatable along with the rotational wheel when the transmission member is located at the second position.

12. The toner detection device of the waste toner container as claimed in claim 1, further comprising a stirring shaft; when the transmission member is located at the first position, the stirring shaft is engaged with the transmission member, such that the stirring shaft is rotatable by the transmission member; when the stirring shaft receives a resistance force and the resistance force gradually increases, the transmission member is pushed to gradually move toward the second position in a way that the stirring shaft is still engaged with the transmission member; when the transmission member is located at the second position, the stirring shaft is disengaged with the transmission member such that the stirring shaft is not rotatable by the transmission member.

13. The toner detection device of the waste toner container as claimed in claim 12, wherein the stirring shaft comprises an axially extending tooth; the transmission member comprises an engagement notch; when the transmission member is located at the first position, the axially extending tooth is engaged into the engagement notch such that the stirring shaft is rotatable with the transmission member.

* * * * *